US005353550A

United States Patent [19]

Iwai et al.

[11] Patent Number: 5,353,550

[45] Date of Patent: Oct. 11, 1994

[54] STEEL BALL POLISHING APPARATUS

[75] Inventors: Tatsuo Iwai; Isao Fujiwara, both of Nara, Japan

[73] Assignee: Isubakimoto Precision Products Co. Ltd., Osaka, Japan

[21] Appl. No.: 191,359

[22] Filed: Feb. 3, 1994

Related U.S. Application Data

[63] Continuation of Ser. No. 899,541, Jun. 16, 1992, abandoned.

[30] Foreign Application Priority Data

Jun. 18, 1991 [JP] Japan ..... 3-171853

[51] Int. Cl.[5] ..... B24B 11/04

[52] U.S. Cl. ..... 451/124; 451/337; 451/339

[58] Field of Search ..... 51/111 R, 117, 130, 51/317, 318, 289 S, 215 M, 215 HM, 215 UE

[56] References Cited

U.S. PATENT DOCUMENTS

| | | | |
|---|---|---|---|
| 967,918 | 8/1910 | Hirth | 51/130 |
| 1,252,364 | 1/1918 | Schaum | 51/130 |
| 1,772,365 | 8/1930 | Pratt | 51/130 |
| 1,898,979 | 2/1933 | Matteson | 51/130 |
| 1,921,686 | 8/1933 | Matteson | 51/130 |
| 1,973,922 | 9/1934 | Dumas | 51/130 |
| 2,764,851 | 10/1956 | Dieterichs | 51/130 |
| 3,348,338 | 10/1967 | Messerschmidt | 51/130 |

*Primary Examiner*—Jack W. Lavinder
*Attorney, Agent, or Firm*—Howson and Howson

[57] ABSTRACT

A steel ball machining apparatus comprises a cylindrical ball storing vessel having an opening, a steel ball machining mechanism, a steel ball supply path for supplying steel balls to said machining mechanism from the opening in said vessel, a steel ball discharge path for discharging the balls from said machining mechanism, and an elevating conveyor is provided between the discharge path and the cylindrical vessel, the elevating conveyor having a ball receiving vessel which is adapted to move between a lower position in which the ball receiving vessel aligns with the discharge path and an upper position over the cylindrical vessel, a lifter of said ball receiving vessel, a ball return path provided at the upper position for feeding the balls from the ball receiving vessel over to the cylindrical vessel, the return path having a ball exit adapted to discharge the balls to said cylindrical vessel at radially different positions therein.

12 Claims, 6 Drawing Sheets

STEEL BALL POLISHING APPARATUS

CROSS REFERENCE TO RELATED APPLICATION

This is a continuation of our application Ser. No. 07/899,541, filed Jun. 16, 1992 now abandoned.

FIELD OF INVENTION

The present invention relates to a steel ball machining apparatus used in flashing, grinding and lapping processes in the manufacturing of steel balls.

BACKGROUND OF INVENTION

Steel balls used in ball bearings, etc., are first made from wire materials into roughly spherical blanks having flashes. Then, they are subjected to flashing process to remove such flashes, heat treatment to impart the required strength and durability to the balls, grinding process thereafter, and lapping process to finish the balls with high accuracy after the grinding process.

FIG. 6 illustrates a steel ball machining apparatus 70 of the prior art, which used the above-mentioned flashing, grinding, and lapping processes. The apparatus 70 comprises a machining mechanism 76 having a rotary plate 72 and a stationary plate 74, and a rotor conveyor 80 having a cylindrical vessel 82 for supplying steel balls 78 between the rotary plate 72 and the stationary plate 74 and receiving the steel balls 78 therefrom.

The steel balls 78 supplied by the conveyor 80 are held between the rotary plate 72 and the stationary plate 74 and after moving through almost a complete circle between the rotary plate 72 and the stationary plate 74, the balls 78 are returned to the conveyor 80. The balls 78 circulate through the machining mechanism 76 and the conveyor 80 until the predetermined dimensional accuracy is attained tained.

The balls 78 discharged near the outer wall 84 of the vessel 82 tend to move along the outer wall 84 and the balls discharged near the inner wall 85 of the vessel 82 tend to move along the inner wall 85 before they are sent out to the machining mechanism. Consequently, it takes a long time to achieve the desired value of the lot diameter vairation (see JIS B 1501), which is one of the most important quality criteria of steel balls for ball bearings.

As the demand for higher quality is increasing these days, it has been necessary, in order to achieve said desired value of the size variation, for an operator to agitate the steel balls contained within the cylindrical vessel. Thus, the object of the present invention is to provide a steel ball machining apparatus which is capable of efficiently mixing steel balls circulating through the cylindrical vessel and the machining mechanism, thereby minimizing the size variation of the processed steel balls.

SUMMARY OF INVENTION

The present invention has solved the abovementioned problems by a steel ball machining apparatus comprising a cylindrical ball storing vessel having an opening, a steel ball machining mechanism, a steel ball supply path for supplying steel balls to said machining mechanism from said opening in said vessel, a steel ball discharge path for discharging said balls from said machining mechanism, and a elevating conveyor provided between said said discharge path and said cylindrical vessel, said elevating conveyor having a ball receiving vessel which is adapted to move between a lower position in which said ball receiving vessel aligns with said discharge path and an upper position over said cylindrical vessel, a lifting means of said ball receiving vessel, a ball return path provided at said upper position for feeding said balls from said ball receiving vessel over to said cylindrical vessel, said return path having a ball exit adapted to discharge said balls to said cylindrical vessel at the radially different positions thereof.

Steel balls to be processed are put into the cylindrical ball storing vessel. As the machining apparatus starts to operate, the steel balls move out of the opening of the cylindrical vessel so as to be supplied to the machining mechanism. The steel balls move through almost a complete circle between the rotary plate and the surface plate. Then, the the balls are introduced to the eliminated conveyor through the discharge path.

The ball receiving vessel is adapted to move up and down intermittently between the upper and lower positions. The steel balls enter the ball receiving vessel from the discharge path at the lowered position. Then, the ball receiving vessel is moved upward to the raised position by means of the lifting means. The return path provided at the upper position is to guide the balls from the ball receiving vessel over to the cylindrical ball storing vessel.

A ball exit is provided to the return path so that the balls may fall into the cylindrical therefrom. Since the exit is arranged to allow the balls to fall into the cylindrical vessel at the radially different positions, the balls are capable of mixing together well while they circulate through the ball machining mechanism and the cylindrical vessel.

EMBODIMENTS

The following embodiment will be described with reference to a flashing process. The machining apparatus used in grinding and lapping processes is almost the same and will be referred to later.

Figure 4:
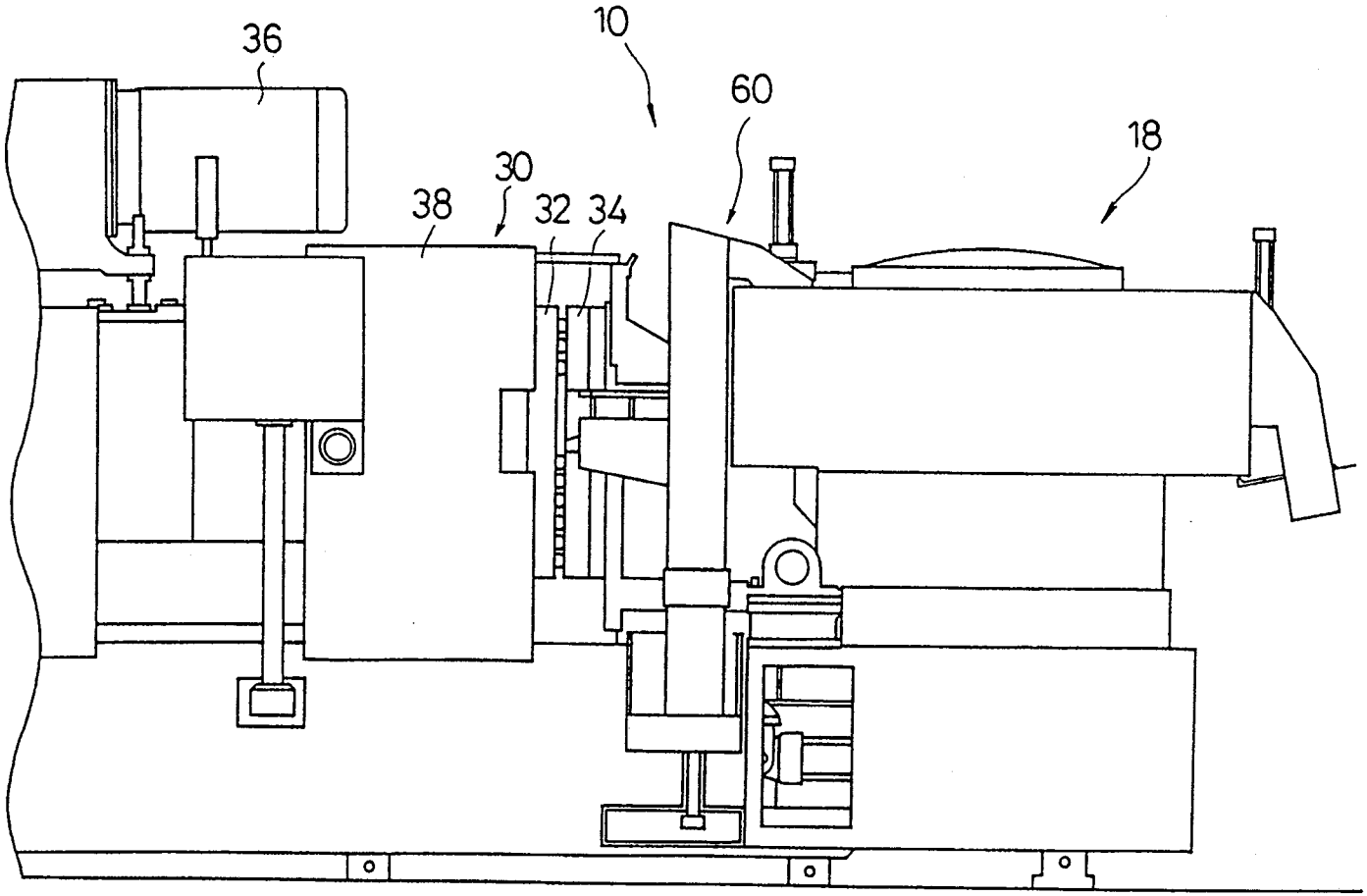
FIG. 4 is a front view of the apparatus shown in FIG. 1.
Figure 5:
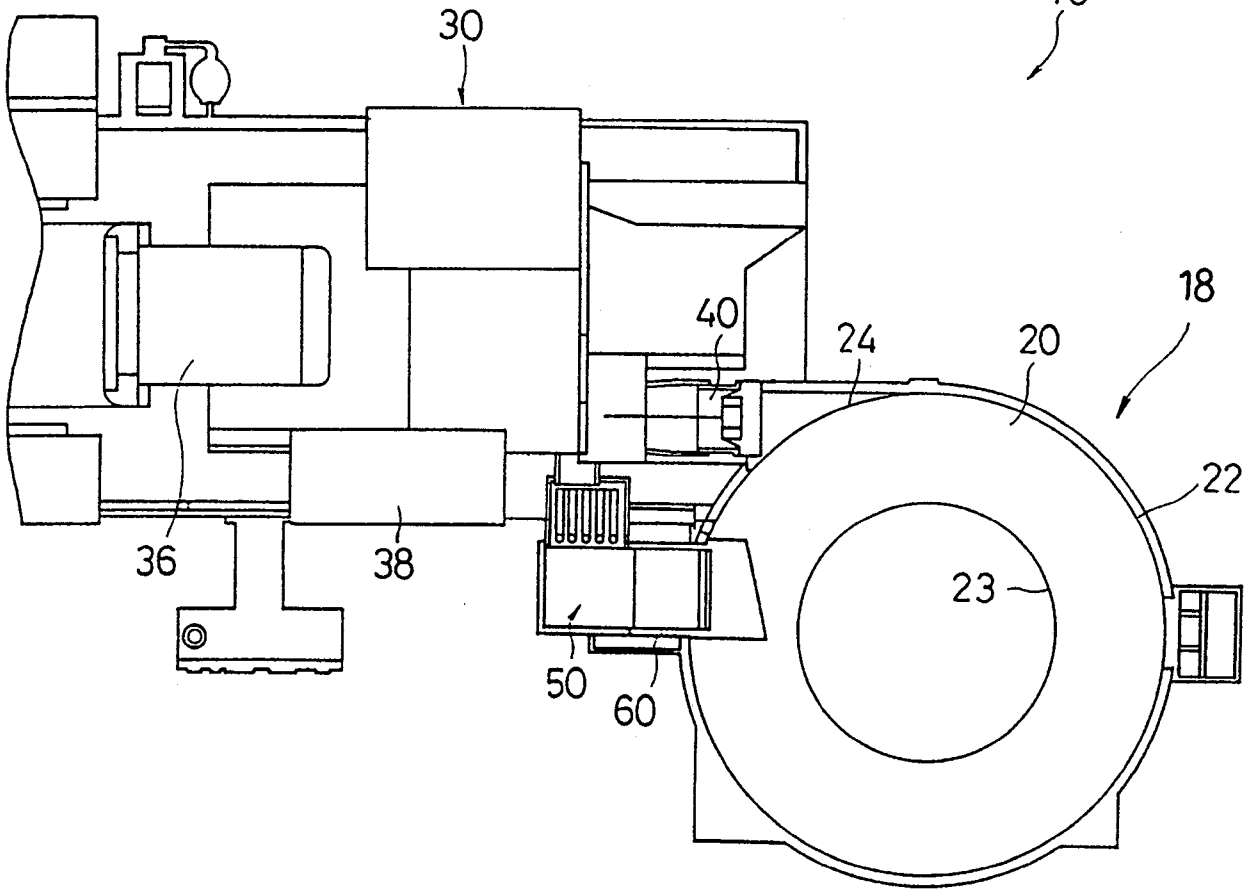
FIG. 5 is a top view of the apparatus shown in FIG. 4.
Figure 6:
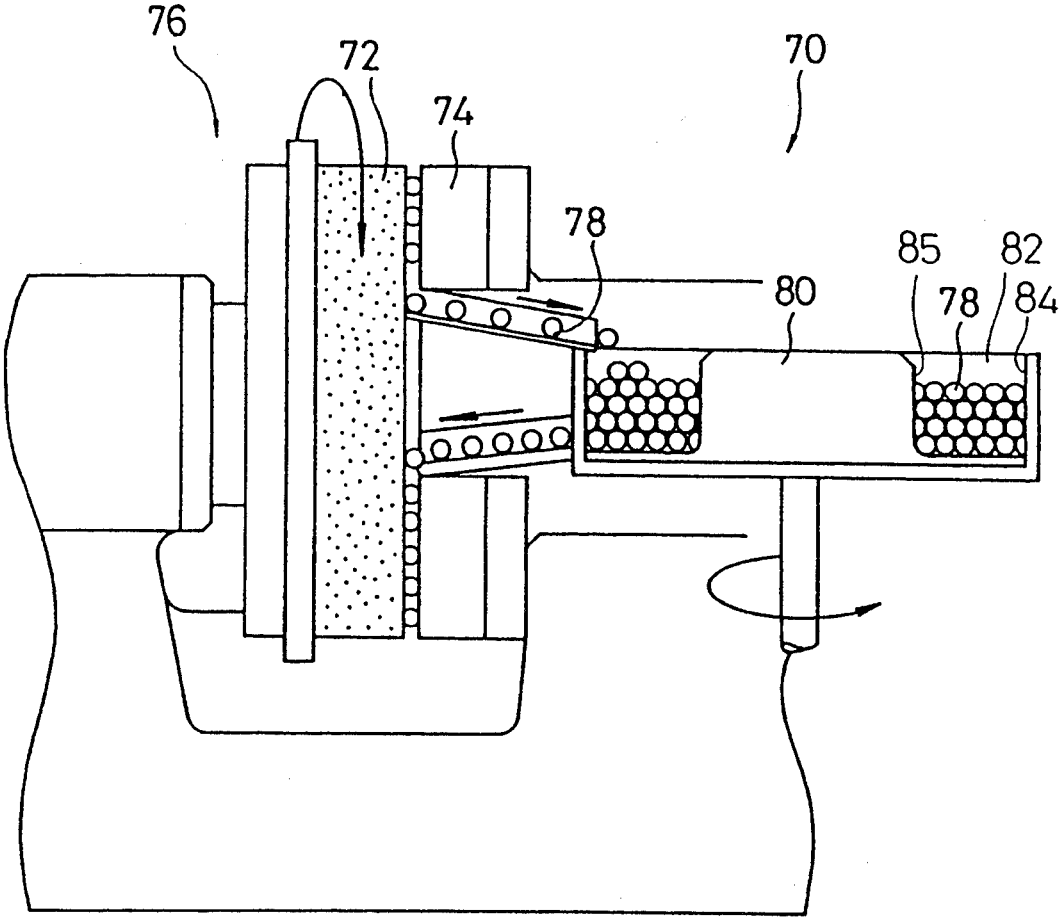
FIG. 6 PRIOR ART
FIG. 6 is a front view of the machining apparatus of prior art.

The overall steel ball machining apparatus 10 is shown in FIGS. 4 and 5. FIG. 4 is a front view and FIG. 5 is a top view. The apparatus 10 comprises a rotor conveyor 18 having a cylindrical steel ball storing vessel 20, and a machining mechanism 30. Steel balls 12 are fed successively from the vessel 20 to the machining mechanism 30. The steel balls move through almost a couple circle while held between the rotary plate (disc) 32 and the stationary plate 34 of the machining mechanism 30 and return to the cylindrical vessel 20 via the elevating conveyor 80. Said process is repeated a number of times.

The machining mechanism 30 comprises a pair of opposing machining plates, namely, a rotary plate 32 and a stationary plate 34. The rotary plate 32 and the surface plate 34 are made of special cast iron which is hardened by heat treatment. The respective opposing surfaces are formed with a plurality of concentric ball grooves with the same pitch. The machining mechanism 30 further comprises a driving means to cause a relative motion between the rotary plate 32 and the stationary plate 34, namely, an electric motor 36, means for adjusting the distance between the rotary plate 32 and the stationary plate 34, pressing means (not shown), and a conduit (not shown) for ejecting a grinding fluid between the rotary plate 32 and the stationary plate 34. The machining mechanism 30 further includes a cover 38 for prevention of the scattering of the grinding fluid. The position of the rotary plate 32 relative to the stationary plate 34 may be adjusted according to the diameter of the processed steel balls and is revolved by the motor 36 while being pressed toward the stationary plate 34.

Figure 1:
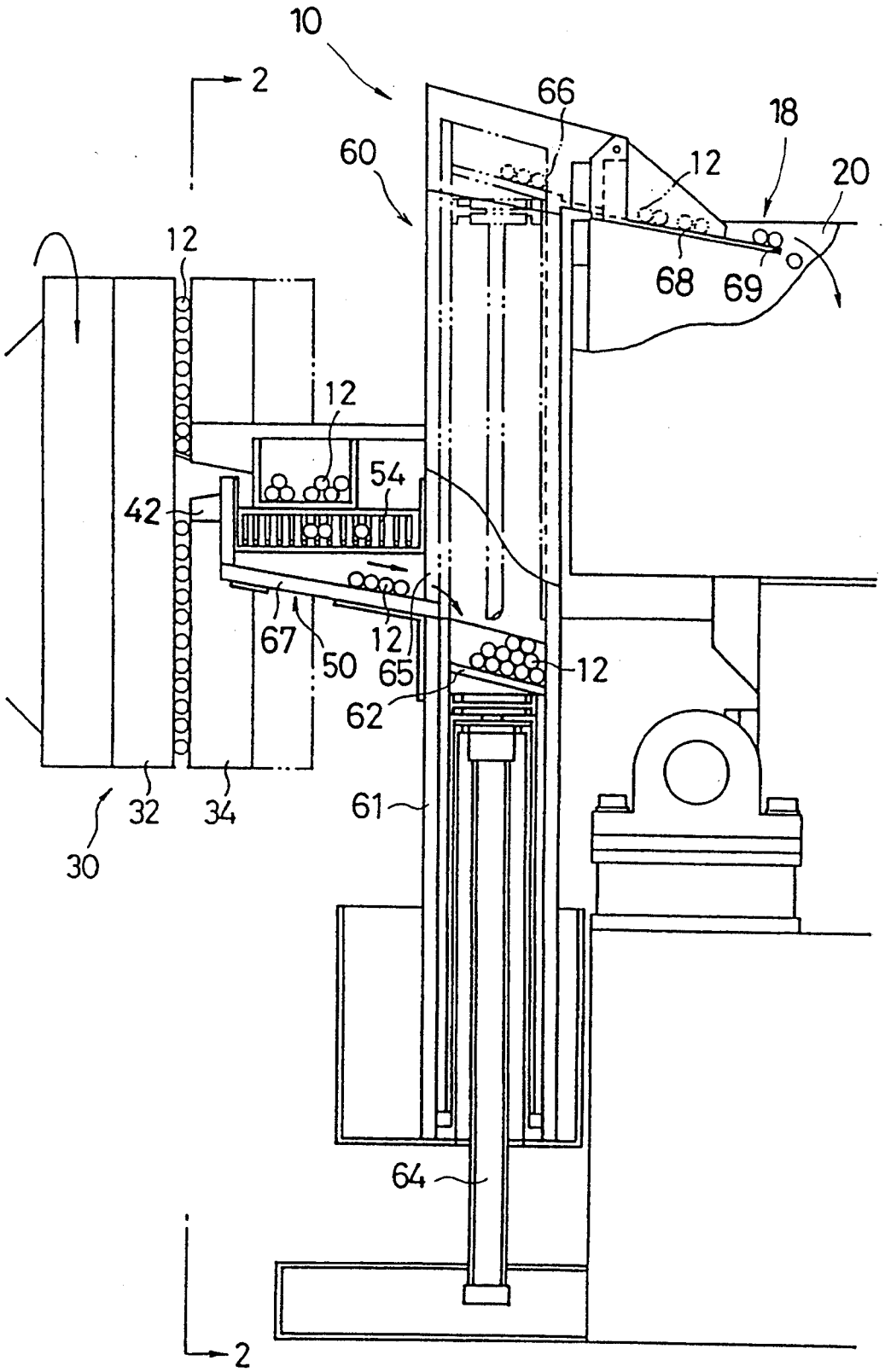
FIG. 1 is a front view partly in section of an embodiment of the steel ball machining apparatus in accordance with the present invention.
Figure 2:
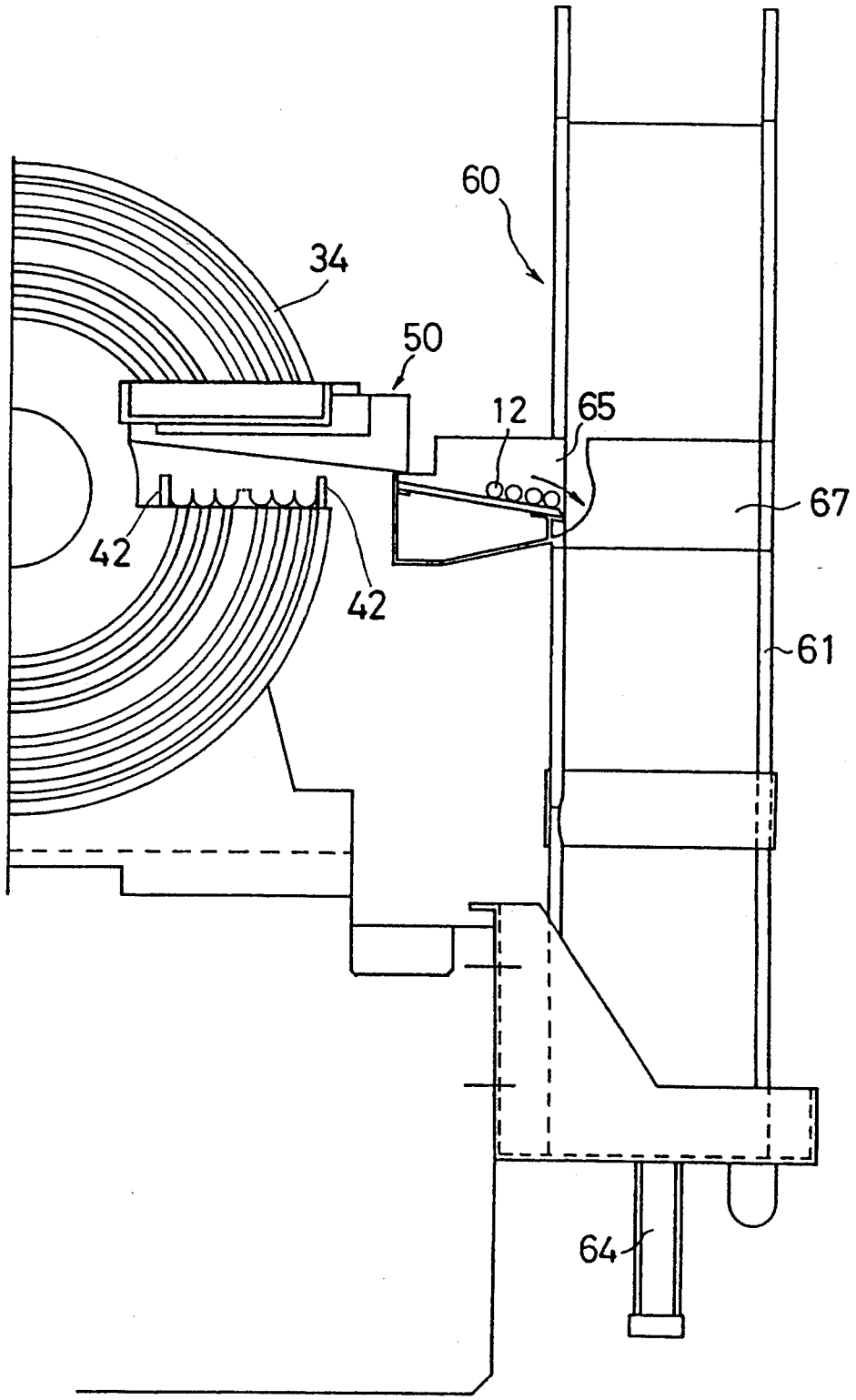
FIG. 2 is a section at line 2—2 in FIG. 1.
Figure 3:
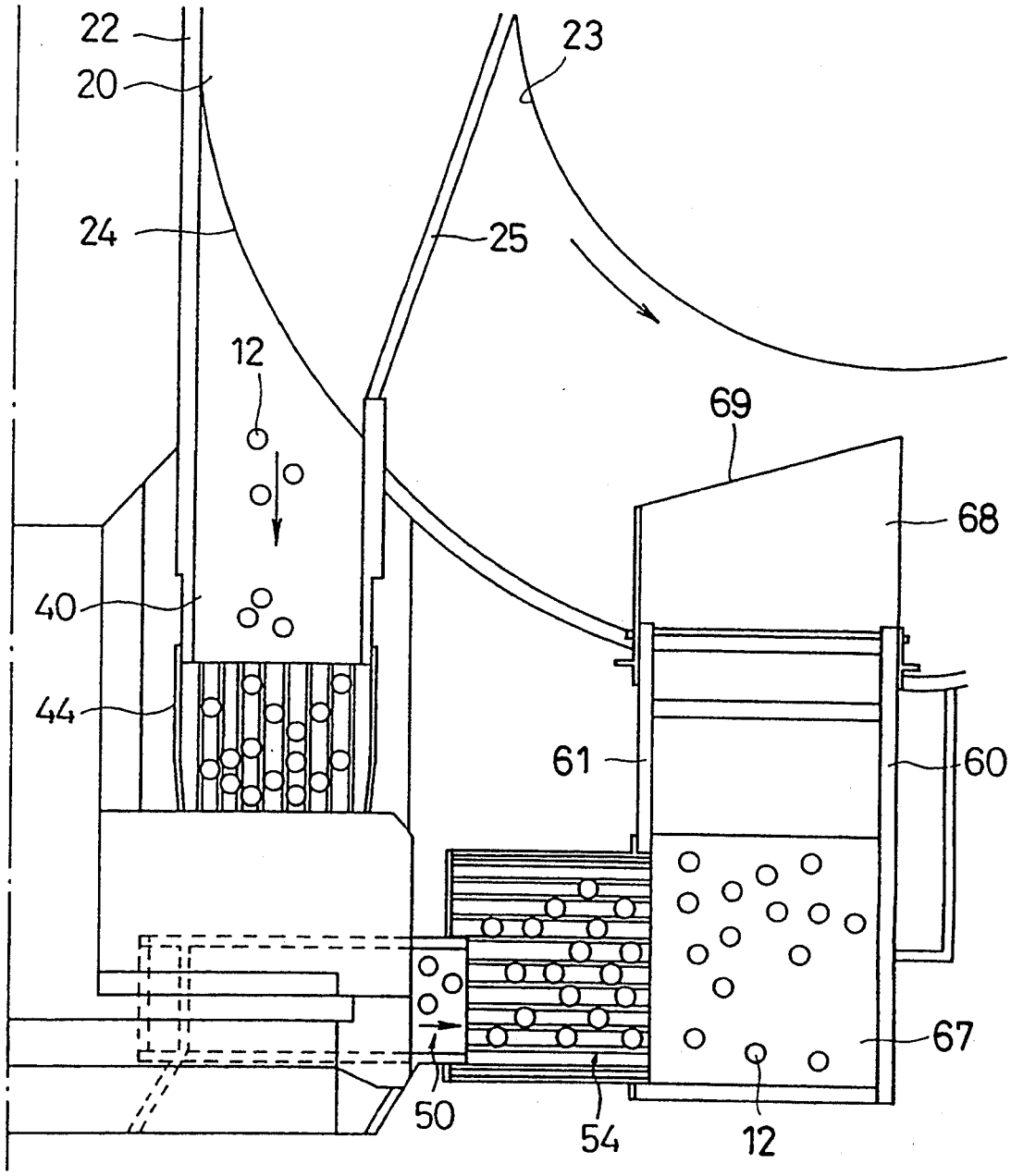
FIG. 3 is an enlarged top view of the ball supply path and ball discharge path in FIG. 1.

As shown in FIGS. 3 and 5, steel balls 12 are accommodated between the outer wall 22 and the inner wall 23 of the cylindrical vessel 20. A part of the outer wall 22 extends tangentially and an opening 24 is formed there. The wall 25 is to prevent the balls 12 from circulating more than once in the vessel 20. The arrow designates the direction of movement of the steel balls 12.

As shown in FIG. 3, a ball supply path 40 is provided between the opening 24 of the vessel 20 and the machining mechanism 30. At downstream of the machining mechanism 30, a ball discharge path 50 and a elevating conveyor 60 are provided so as to return the balls 12 to the cylindrical vessel 20.

The stationary plate 34 is recessed at one point so as to supply and discharge the balls 12. A guide 42 is provided to the supply path 40 over the lower recess of the stationary plate 34 having the grooves with the same pitch as the ball grooves of the rotary plate 32 and the stationary plate 34. Since a set of parallel bars 44 and 54 is provided in the supply path 40 and discharge path 50, respectively, flashes, etc., which tend to accidentally mix with the processed steel balls may be removed immediately before the balls enter the machining mechanism 30 and immediately after the balls left the machining mechanism 30.

Now, operation of the apparatus 10 will be explained.

The steel balls 12 which are to be processed are first put into the cylindrical vessel 20. The distance between the rotary disc 32 and the stationary plate 34 is narrowed to be less than the diameter of the balls 12. Starting the rotor conveyor 18, steel balls 12 are fed to the machining mechanism 30 through the supply path 40. The balls 12 will pass over the set of parallel bars 44 of the supply path 40 and are then guided along the grooves provided in the guide 42 and then come into contact with the ball grooves in the rotary plate 32. The operator will manually adjust the distance between the rotary plate 32 and the stationary plate 34 so that the balls may be properly held therebetween within the grooves.

The balls 12 are then introduced into the grooves formed in the rotary plate 32 and the stationary plate 34. The cover 38 shields the rotary plate 32 and the stationary plate 34. A grinding fluid ejects toward the ball grooves in the rotary plate 32 and the machining mechanism 30 is turned on. As the motor 36 starts, the rotary plate 32 starts to rotate relative to the stationary plate 34 in a clockwise direction. The balls 12 move through almost a complete circle in the grooves and discharged to the discharge path 50 along with the fluid. The balls 12 will pass over the set of parallel bars 54 and are returned to the vessel 20 through the elevating conveyor 60 which functions intermittently. A number of steel balls 12 are thus continuously supplied from the vessel 20 and they are held between the rotary plate 32 and the stationary plate 34 under pressure. Until the desired dimensional accuracy is attained, the balls 12 will circulate between the machining mechanism 30 and the vessel 20. The rotations of the conveyor 18 and the rotary plate 32 are adjusted so that a number of balls 12 may be circulated under a well-balanced condition. The pressure between the the rotary plate 32 and the stationary plate 34 is hydraulically controlled. The pressure is adapted to gradually increase from zero and it is automatically controlled so that the energy consumption at the motor 36 may be maintained within the prescribed range.

A elevating conveyor 60 is disposed at downstream of the discharge path 50 so as to return the balls 12 discharged from the machining mechanism 30 to the vessel 20. The elevating conveyor 60 comprises a hollow column 61 and a ball receiving vessel 62 which may be raised or lowered by means of a pneumatic cylinder 64. Further, an opening 65 is formed at the lower position of the column 61 and another opening 66 is formed at the upper, opposite side of the column 61. A steel ball receiving plate 67 aligns with lower opening 65.

A ball return path 68 is provided at the upper position so as to align with the upper opening 66 of the column 61 and extends over the cylindrical vessel 20. At one end thereof, a ball exit 69 is formed so as to radially extend toward the vessel 20. As shown in FIG. 3, the tip thereof is cut aslant.

When the ball receiving vessel 62 is at the lower position, the balls 12 may enter the ball receiving vessel 62 via the ball receiving plate 67 and the opening 65. When the ball receiving vessel 62 goes up, the opening 65 is closed automatically, and the balls on the plate 67 are accumulated thereon. It is also possible to provide a sensor to the plate 67 such that the cylindrical ball storing vessel 20 and the machining mechanism 30 may be stopped if the balls 12 are accumulated excessively.

As the ball receiving vessel 62 goes up to align with the upper opening 66, the balls 12 in the ball receiving vessel 62 are sent out to the feeding path 68 and are finally discharged into the cylindrical ball storing vessel 20 from the exit 69.

It will be appreciated that the elevating conveyor 60 is capable of returning the balls 12 to the vessel 20 at the radially different positions. After moving through almost a complete circle in the cylindrical vessel 20, the balls 12 are fed to the machining mechanism 30 through the supply path 40. As the balls 12 circulate through the vessel 20 and the machining mechanism 30 several times, the probability that the balls 12 are processed by the same ball groove is remarkably reduced, thereby minimizing the size variation of the balls.

The above-described embodiment has been made with reference to a flashing process. Substantially the same apparatus is used in grinding and lapping processes as well. The differences reside in that the rotary plate is a grinding wheel having ball grooves and that the stationary plate is made of special cast iron which is not heat treated and that the pawl to guide steel balls held between the rotary plate and the stationary plate to the discharge path is made of plastics as compared with the pawl in the flashing process being made of metal.

ADVANTAGES OF INVENTION

As the balls may be fully agitated while they pass the discharge path 50, parallel bars 54 and the ball receiving plate 67 until they reach the feeding path 68 and are discharged at the radially different positions of the cylindrical ball storing vessel 20, the balls tend to be processed by the different ball grooves of the machining mechanism. Thus, the size variation of the balls may be minimized and the time required to obtain the balls having the desired dimensional accuracy may be shortened. Especially, by reducing the size variation of the balls in the flashing process, it becomes possible to shorten the time required for the subsequent grinding and lapping processes, thereby remarkably reducing the overall processing time. In addition, conventional agitation of the balls by human hands may be eliminated.

Furthermore, since it is possible to reduce the size variation in a shorter time period, the finished steel balls may be obtained in a larger "lot" (namely, a unit container) by increasing the height of the cylindrical ball storing vessel in combination with the use of a elevating conveyor. This also makes it possible to shorten the overall processing time by reducing the number of times the "lot" of the finished balls is replaced by the next "lot" to be processed.

What is claimed is:

1. A steel ball machining apparatus comprising:

a cylindrical ball storing vessel at a first level, said vessel having a central axis, an outer periphery, an upper opening for receiving balls and a discharge opening for discharging balls outwardly across said periphery;

a steel ball machining mechanism;

means providing a steel ball supply path for supplying steel balls to said machining mechanism from the discharge opening in said vessel;

means providing a discharge path for discharging said balls from said machining mechanism;

an elevating conveyor provided between said discharge path and said cylindrical vessel, said elevating conveyor having a ball receiving vessel movable between a lower position in which said ball receiving vessel is aligned with said discharge path and an upper position above said first level;

means for lifting said ball receiving vessel; and means providing a ball return path for feeding said balls from said ball receiving vessel over to said cylindrical vessel when said ball receiving vessel is located at said upper position;

in which said return path comprises a plate extending from the exterior of said cylindrical vessel inwardly across said periphery in a direction toward a location above said upper opening, said plate having a width, transverse to said direction, sufficient to accommodate multiple steel balls in side-by-side relationship, and means for discharging balls from said lifting means onto said plate such that the balls discharged onto the plate travel along the plate, in said direction, toward said location above said upper opening, at multiple, different positions across the width of the plate, said plate having ball exit means for discharging said balls to said cylindrical vessel, said ball exit means comprising an edge of the plate, said edge extending at an acute angle relative to said direction, whereby balls rolling on said plate at said different positions therein are discharged, over said edge, into said cylindrical vessel at radially different positions relative to the central axis of the storing vessel.

2. A steel ball machining apparatus according to claim 1 in which said means providing a discharge path comprises ball-accumulating means disposed in said discharge path between said machining mechanism and said elevating conveyor, for receiving balls from said machining mechanism, means for preventing movement of balls from said ball-accumulating means to said elevating conveyor when the elevating conveyor is moved away from its lower position, but allowing balls to move from said ball-accumulating means to said elevating conveyor when the elevating conveyor is in said lower position, whereby the degree of mixing of machined balls is improved.

3. A steel ball machining apparatus according to claim 2 in which the elevating conveyor comprises a hollow column in which said ball receiving vessel is movable from said lower position to said upper position, in which said hollow column has a column entrance opening positioned so that it is disposed adjacent to the ball receiving vessel when said ball receiving vessel is in said lower position, in which said ball-accumulating means comprises a plate positioned outside said hollow column adjacent to said column entrance opening, and in which said means for preventing movement of balls from said ball-accumulating means to said elevating conveyor comprises means for closing said entrance opening.

4. A steel ball machining apparatus according to claim 1 including means for moving said ball receiving vessel up and down intermittently.

5. A steel ball machining apparatus comprising:

a cylindrical ball storing vessel at a first level, said vessel having a central axis, a cylindrical outer wall, a cylindrical inner wall coaxial with said outer wall, an upper opening for receiving balls and a discharge opening for discharging balls outwardly across said outer wall, and means for moving balls around said central axis in a circular path between said inner and outer walls;

a steel ball machining mechanism;

means providing a steel ball supply path for supplying steel balls to said machining mechanism from the discharge opening in said vessel;

means providing a discharge path for discharging said balls from said machining mechanism;

an elevating conveyor provided between said discharge path and said cylindrical vessel, said elevating conveyor having a ball receiving vessel movable between a lower position in which said ball receiving vessel is aligned with said discharge path and an upper position above said first level;

means for lifting said ball receiving vessel; and means providing a ball return path for feeding said balls from said ball receiving vessel over to said cylindrical vessel when said ball receiving vessel is located at said upper position;

in which said return path comprises a plate extending from the exterior of said cylindrical vessel inwardly across said outer wall in a direction toward a location above said upper opening, said plate having a width, transverse to said direction, sufficient to accommodate multiple steel balls in side-by-side relationship, and means for discharging balls from said lifting means onto said plate such that the balls discharged onto the plate travel along the plate, in said direction, toward said location above said upper opening, at multiple, different positions across the width of the plate, said plate having ball exit means for discharging said balls to said cylindrical vessel, said ball exit means comprising an edge of the plate, said edge having first and second ends, the first end of said edge being closer than the second end of said edge to said inner wall, whereby balls rolling on said plate at said different positions therein are discharged, over said edge, into said cylindrical vessel between said inner and outer walls, at radially different positions relative to the central axis of the storing vessel.

6. A steel ball machining apparatus according to claim 5 in which said means providing a discharge path comprises ball-accumulating means disposed in said discharge path between said machining mechanism and said elevating conveyor, for receiving balls from said machining mechanism, means for preventing movement of balls from said ball-accumulating means to said elevating conveyor when the elevating conveyor is moved away from its lower position, but allowing balls to move from said ball-accumulating means to said elevating conveyor when the elevating conveyor is in said lower position, whereby the degree of mixing of machined balls is improved.

7. A steel ball machining apparatus according to claim 6 in which the elevating conveyor comprises a hollow column in which said ball receiving vessel is movable from said lower position to said upper position, in which said hollow column has a column entrance opening positioned so that it is disposed adjacent to the ball receiving vessel when said ball receiving vessel is in said lower position, in which said ball-accumulating means comprises a plate positioned outside said hollow column adjacent to said column entrance opening, and in which said means for preventing movement of balls from said ball-accumulating means to said elevating conveyor comprises means for closing said entrance opening.

8. A steel ball machining apparatus according to claim 5 including means for moving said ball receiving vessel up and down intermittently.

9. A steel ball machining apparatus comprising:

a cylindrical ball storing vessel at a first level, said vessel having a central axis, a cylindrical outer wall, a cylindrical inner wall coaxial with said outer wall, an upper opening for receiving balls and a discharge opening for discharging balls outwardly across said outer wall, and means for moving balls around said central axis in a circular path between said inner and outer walls;

a steel ball machining mechanism;

means providing a steel ball supply path for supplying steel balls to said machining mechanism from the discharge opening in said vessel;

means providing a discharge path for discharging said balls from said machining mechanism;

an elevating conveyor provided between said discharge path and said cylindrical vessel, said elevating conveyor having a ball receiving vessel movable between a lower position in which said ball receiving vessel is aligned with said discharge path and an upper position above said first level;

means for lifting said ball receiving vessel; and means providing a ball return path for feeding said balls from said ball receiving vessel over to said cylindrical vessel when said ball receiving vessel is located at said upper position;

in which said return path comprises a plate extending from the exterior of said cylindrical vessel inwardly across said outer wall in a direction toward a location above said upper opening, said plate having a width, transverse to said direction, sufficient to accommodate multiple steel balls in side-by-side relationship, and means for discharging balls from said lifting means onto said plate such that the balls discharged onto the plate travel along the plate, in said direction, toward said location above said upper opening, at multiple, different positions across the width of the plate, said plate having ball exit means for discharging said balls to said cylindrical vessel, said ball exit means comprising an edge of the plate, said edge having first and second ends and extending at an acute angle relative to said direction such that the first end of said edge is closer than the second end of said edge to said inner wall, whereby balls rolling on said plate at said different positions therein are discharged, over said edge, into said cylindrical vessel between said inner and outer walls, at radially different positions relative to the central axis of the storing vessel.

10. A steel ball machining apparatus according to claim 9 in which said means providing a discharge path comprises ball-accumulating means disposed in said discharge path between said matchining mechanism and said elevating conveyor, for receiving balls from said machining mechanism, means for preventing movement of balls from said ball-accumulating means to said elevating conveyor when the elevating conveyor is moved away from its lower position, but allowing balls to move from said ball-accumulating means to said elevating conveyor when the elevating conveyor is in said lower position, whereby the degree of mixing of machined balls is improved.

11. A steel ball machining apparatus according to claim 10 in which the elevating conveyor comprises a hollow column in which said ball receiving vessel is movable from said lower position to said upper position, in which said hollow column has a column entrance opening positioned so that it is disposed adjacent to the ball receiving vessel when said ball receiving vessel is in said lower position, in which said ball-accumulating means comprises a plate positioned outside said hollow column adjacent to said column entrance opening, and in which said means for preventing movement of balls from said ball-accumulating means to said elevating conveyor comprises means for closing said entrance opening.

12. A steel ball machining apparatus according to claim 9 including means for moving said ball receiving vessel up and down intermittently.

* * * * *